US009771678B2

(12) United States Patent
Zhang

(10) Patent No.: US 9,771,678 B2
(45) Date of Patent: Sep. 26, 2017

(54) CLOTHING STEAM IRONING APPARATUS

(76) Inventor: Yunfeng Zhang, Qinhuangdao (CN)

( * ) Notice: Subject to any disclaimer, the term of this patent is extended or adjusted under 35 U.S.C. 154(b) by 754 days.

(21) Appl. No.: 13/806,306

(22) PCT Filed: Jun. 28, 2011

(86) PCT No.: PCT/CN2011/076472

§ 371 (c)(1),
(2), (4) Date: Dec. 21, 2012

(87) PCT Pub. No.: WO2012/010044

PCT Pub. Date: Jan. 26, 2012

(65) Prior Publication Data

US 2013/0086954 A1 Apr. 11, 2013

(30) Foreign Application Priority Data

| | | |
|---|---|---|
| Jul. 20, 2010 | (CN) | 2010 2 0267990 U |
| Jan. 19, 2011 | (CN) | 2011 2 0017226 U |
| May 17, 2011 | (CN) | 2011 2 0156240 U |

(51) Int. Cl.

| | |
|---|---|
| ***D06F 75/20*** | (2006.01) |
| ***D06F 73/00*** | (2006.01) |
| ***D06F 75/12*** | (2006.01) |
| ***D06F 75/30*** | (2006.01) |
| *D06F 87/00* | (2006.01) |

(52) U.S. Cl.

CPC ..... *D06F 75/20* (2013.01); *D06F 73/00* (2013.01); *D06F 75/12* (2013.01); *D06F 75/30* (2013.01); *D06F 87/00* (2013.01)

(58) Field of Classification Search

CPC ..... D06F 73/00; D06F 75/12; D06F 75/20; D06F 75/30; D06F 87/00

See application file for complete search history.

(56) References Cited

U.S. PATENT DOCUMENTS

| | | | | |
|---|---|---|---|---|
| 3,061,959 | A * | 11/1962 | Blumenfeld | A47L 5/14 15/320 |
| 3,721,026 | A * | 3/1973 | McCallum | D06F 43/002 38/75 |
| 3,738,385 | A * | 6/1973 | Gerod | D06F 71/34 137/606 |
| 3,919,729 | A * | 11/1975 | Cannan | A47L 11/34 134/21 |
| 5,613,271 | A | 3/1997 | Thomas | |

(Continued)

FOREIGN PATENT DOCUMENTS

| | | |
|---|---|---|
| CN | 1496430 | 5/2004 |
| CN | 201155060 | 11/2008 |
| CN | 201722542 | 1/2011 |

(Continued)

OTHER PUBLICATIONS

Machine Translation of Whitaker, DE 4244590 C1, Oct. 1994.*

(Continued)

*Primary Examiner* — David Cormier

(74) *Attorney, Agent, or Firm* — Morris & Kamlay LLP

(57) ABSTRACT

Disclosed is a clothing steam ironing apparatus, comprising an ironing component (3) with an ironing panel, steam ejection holes (7) for ejecting steam to iron a clothing and air suction holes (8) for generating a suck force to the clothing are provided in the ironing panel.

4 Claims, 3 Drawing Sheets

(56) References Cited

U.S. PATENT DOCUMENTS

| | | | | |
|---|---|---|---|---|
| 2004/0084433 | A1* | 5/2004 | Field | D06F 75/08 219/221 |
| 2009/0255302 | A1* | 10/2009 | Haan | D06F 73/00 68/222 |

FOREIGN PATENT DOCUMENTS

| | | | | |
|---|---|---|---|---|
| DE | 4244590 | C1 * | 10/1994 | D06F 75/08 |
| EP | 1300502 | | 4/2003 | |
| IT | EP 0493348 | A1 * | 7/1992 | D06F 87/00 |
| WO | 02/18698 | | 3/2002 | |
| WO | 02070811 | A2 | 9/2002 | |

OTHER PUBLICATIONS

Extended European Search Report dated Aug. 4, 2014 from EPO in counterpart European Patent Application No. 11809232.9.

International Search Report dated Oct. 13, 2011 From the International Searching Authority Re.: Application No. PCT/CN2011/076472.

* cited by examiner

CLOTHING STEAM IRONING APPARATUS

BACKGROUND OF THE INVENTION

Field of Invention

The present invention relates to a clothing steam ironing apparatus, particularly to one suitable for ironing clothing while the clothing is hanging.

Description of the Related Art

Steam ironing for clothing has advantages of high efficiency, good ironing effect, and no bad influence to the surface and texture of the clothing. Further, due to elimination of the need of a flat bench, hanging arrangement for steam ironing is especially convenient.

However, some disadvantages exist in prior ironing apparatus in hanging arrangement. For example, because there is no support at the back side of the hanging clothing, the ironing operation is a bit difficult and the clothing will not be ironed as smooth as it would be by ironing with pressure (such as, the back side of the clothing is supported by a rigid body). Thus the ironing efficiency and effect may not satisfy the increasing demand nowadays.

In addition, prior clothing steam ironing apparatus could be only used in clothing ironing, and could not perform other useful function like dust elimination. Accordingly, prior ironing apparatus only has a single function.

SUMMARY OF THE INVENTION

The present invention has been made to overcome or alleviate at least one aspect of the above mentioned disadvantages.

According to an aspect of the present invention, there is provided a clothing steam ironing apparatus, comprising an ironing component with an ironing panel. Steam ejection holes for ejecting steam to iron clothing and air suction holes for generating a suck force to the clothing are provided in the ironing panel.

Preferably, the ironing component further comprises a steam chamber and an air chamber separated from the steam chamber, the steam chamber being in fluid communication with the steam ejection hole and the air chamber being in fluid communication with the air suction hole.

Preferably, the ironing component is provided with an air vent being in fluid communication with the air chamber, a fan is provided in the air chamber.

Preferably, a dust collection device equipped with a filter is provided between the fan and the air suction hole.

Preferably, the steam ejection holes are located at the center of the ironing panel and the air suction holes are located at the periphery of the ironing panel.

Preferably, the clothing steam ironing apparatus further comprises a mount for providing steam.

Preferably, a vertical telescopic pole bracket is provided in the mount.

Preferably, the clothing steam ironing apparatus further comprises a fan control switch for switching the fan on and off and for adjusting the velocity of the wind blown by the fan.

According to another aspect, present invention provides a clothing steam ironing apparatus, comprising a mount including a steam generating device therein and an ironing head which connects at an end of a steam pipe led from the mount and connects with the steam generating device through the steam pipe; wherein the ironing head comprises a steam chamber and an air suction chamber separated from the steam chamber; steam ejection holes connecting with the steam chamber and air suction holes connecting with the air suction chamber are dispersedly formed in an ironing panel of the ironing head; a fan is mounted in the mount; an air discharge port of the fan is in fluid communication with an air vent formed in a housing of the mount; an air intake port of the fan connects with one end of an air intake pipe, the other end of the air intake pipe connects with the air suction chamber of the ironing head.

Preferably, the clothing steam ironing apparatus further comprises a dust collection device which is provided in the mount and located between the air intake port of the fan and the air intake pipe, or the dust collection device is provided in the air suction chamber.

According to another aspect, the present invention provides a clothing steam ironing apparatus with cleaning function, the apparatus comprises a mount including a steam generating device therein, the mount is equipped with a vertical telescopic pole bracket, a steam pipe connects with the steam generating device at one end and connects with an ironing head at the other end, wherein the ironing head comprises a steam ejection chamber and an air suction chamber; steam ejection hole connecting with the steam chamber and air suction hole connecting with the air suction chamber are formed in an ironing panel of the ironing head; a fan is mounted in the air suction chamber; a dust collection device with a filter is provided between the fan and the air suction hole, and an air vent for the air suction chamber is provided in a housing of the ironing head at the rear lower side of the fan.

According to yet another aspect, present invention provides a clothing steam ironing apparatus, comprising a mount including a steam generating device therein and an ironing head which connects at an end of a steam pipe led from the mount and connects with the steam generating device through the steam pipe; wherein the ironing head comprises a steam chamber and an air suction chamber separated from the steam chamber; steam ejection holes connecting with the steam chamber and air suction holes connecting with the air suction chamber are dispersedly formed in an ironing panel of the ironing head; the steam chamber is in fluid communication with the steam pipe and the steam ejection holes, the air chamber is in fluid communication with the air suction holes; a fan is mounted in the ironing head; an air intake port and an air discharge port of the fan are in fluid communication with the air chamber and an air outlet formed in the ironing head, respectively.

Compared with existing technology, present invention is advantageous in at least following aspects:

Due to the presence of the air suction holes, the ironing side of the clothing will stick to the ironing panel when the ironing panel contacts the clothing to be ironed. The operator could move the ironing apparatus when ironing the clothing, so it is convenient for the user to iron the clothing; meanwhile, the clothing could be ironed smooth. Therefore, both of the ironing efficiency and effect are enhanced.

By combining air suction holes and dust collection device, the clothing, as well as bedding, sofa and seat cushion could be dusted when the ironing panel of the ironing head contacts them. Furthermore, by virtue of the high temperature of the steam, the ironing apparatus of present invention further provide a sterilization function, so that the hazard to health of human, especially old people and children, incurred by the dust, pollen, acarus and other pollutants might be reduced. Thus, the clothing will undergo a cleaning and sterilizing process when being ironed by the ironing apparatus of present invention.

In a preferred embodiment, a fan control switch is provided, which enables steam ironing and dusting operations simultaneously, or independently.

DETAILED DESCRIPTION OF PREFERRED EMBODIMENTS

Figure 1:
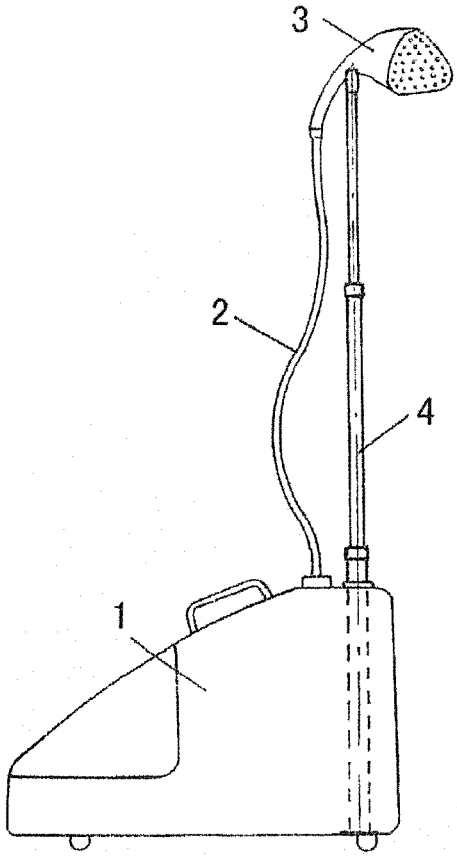
FIG. 1 is a schematic view of the configuration of the clothing steam ironing apparatus according to a first embodiment of present invention.

Preferred embodiments of the present invention will be described hereinafter in detail with reference to the attached drawings, wherein the like reference numerals refer to the like elements throughout the specification. These embodiments should not be construed as being limited to the embodiment set forth herein, rather for illustrative purpose.

In description hereafter, "clothing steaming ironing apparatus" may be referred to as "clothing steam hanging ironing apparatus". Thus, though presented in different expressions, the two terms have substantially same meaning.

Figure 2:
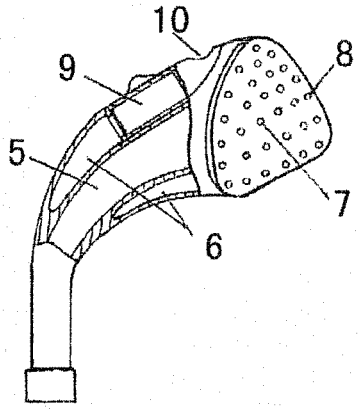
FIG. 2 is a schematic view of an ironing component of the clothing steam ironing apparatus according to a first embodiment of present invention.

As illustrated in FIGS. 1, 2, the first embodiment of the clothing steam ironing apparatus according to present invention comprises an ironing component 3 which includes an ironing panel (better seen in FIG. 2). Steam ejection holes 7 and suction holes 8 are provided in the ironing panel, and during use, the steam is ejected from the steam ejection holes 7 to iron the clothing while the suction holes 8 inhale air to generate a sucking force to the clothing.

In clothing steam ironing apparatus according to present invention, due to the sucking force provided by the suction holes 8, the side of the clothing being ironed is stuck to the ironing panel closely. The operator could move ironing component while ironing the clothing, which is convenient for the user on the one hand, and on the other hand, the fabric of the clothing could be ironed smooth. Therefore, both of the ironing efficiency and effect are enhanced.

In prefer embodiment of present invention, as illustrated in FIG. 2, the ironing component 3 further comprises a steam chamber 5 and an air suction chamber 6 separated from the steam chamber 5. The steam chamber 5 is in fluid communication with the steam ejection holes 7, and the air suction chamber 6 is in fluid communication with the suction holes 8.

It should be noted that, the configuration of the steam chamber and the air suction chamber taught above is a preferred embodiment of present invention, but present invention is not limited to that and those skilled in the art could adopt any possible ways. In other words, any suitable configuration that could provide an appropriate channel for conveying steam and air to the ironing panel could be employed as alternatives to the configuration illustrated in FIGS. 1-2.

Figure 4:
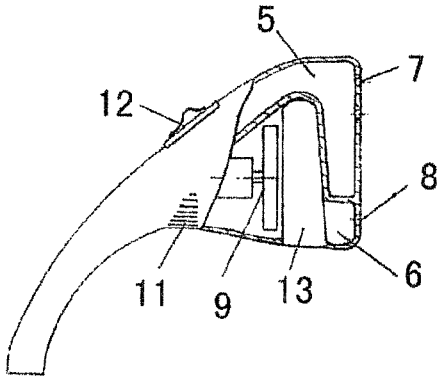
FIG. 4 is a schematic view of an ironing component of the clothing steam ironing apparatus according to a second embodiment of present invention.

Actually, referring to FIG. 4, another configuration of steam chamber and air suction chamber is illustrated. In the embodiment of FIG. 4, a dust collection and filter 13 is provided between the suction holes 8 and the fan 9 inside the air suction chamber 6.

Figure 5:
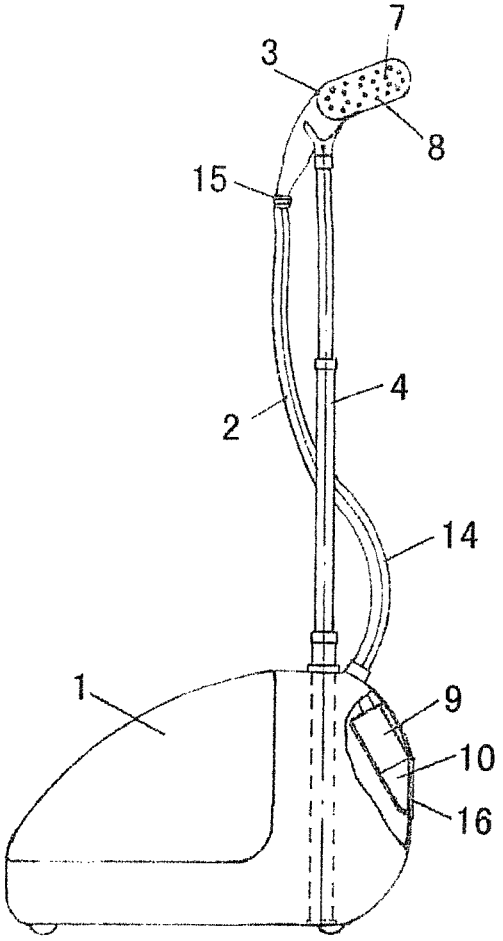
FIG. 5 is a schematic view of the configuration of the clothing steam ironing apparatus according to a third embodiment of present invention.

Referring to FIG. 2 again, according to the first embodiment of present invention, ironing component 3 is provided with an air outlet 10 which is in fluid communication with the air suction chamber 6. Alternatively, the air outlet 10 could be provided in the mount 1. Accordingly, the location of the air outlet shown in FIG. 2 shall not be construed as a limit to present invention. Actually, according to another embodiment of present invention, the air outlet 10 could be formed in the mount 1 as illustrated in FIG. 5 as well.

FIG. 2 illustrates that the fan 9 is provided in the air suction chamber 6. The air intake port and the air discharging port of the fan 9 are in fluid connection with the air suction chamber 6 and the outlet 10, respectively. The intake of air is achieved by the rotation of the fan 9. To control the fan, a fan control switch (not shown) is provided for starting up and turning off the fan and for adjusting the wind speed outputted by the fan. Thus, an operator could select a suitable wind speed which corresponds to the force of the sucking force as desired, and switch the fan on and off independently. That is, the switch enables a flexible control over the fan, the operator could select use or not to use the fan during ironing process, or the operator could use the fan to dust the clothing only, i.e., without ironing the clothing.

According to the first embodiment of present invention, as illustrated in FIG. 2, the steam ejection holes 7 are dispersedly formed in center of the ironing panel, and the suction holes 8 are formed at the periphery of the ironing panel. Correspondingly, in the first embodiment, the steam chamber 5 and the air suction chamber 6 are separated from each other, and more specifically, the centrally positioned steam chamber 5 are surrounded by the air suction chamber 6.

According to the first embodiment, the mount 1 is used to provide steam, that is, a steam generator such as configured as a water tank with an electric heater therein is provided in the mount 1. A steam pipe 2 connects with the steam outlet of the steam generator and is led from the mount 1, preferably, the steam pipe 2 is a flexible heat-resistant and heat insulation pipe. The other end of the steam pipe 2 communicates with the steam chamber 5. It should be understood that present invention is not limited to the steam generator and steam pipe configuration as above, those skilled in the art could configure the steam generator otherwise and arrange the steam pipe elsewhere according to the requirement of actual application.

According to the first embodiment of present invention, a vertical telescopic pole bracket 4 is provided in the mount 1 as a bracket for placing the ironing component and for hanging the clothing. The bracket 4, being of a telescopic pole, is advantageous in storing the ironing apparatus when not in use, and in allowing the height of the bracket to be adjusted, which is convenient for ironing work. Per the actual application, those skilled in the art could employ a fixed type mount or a movable one.

Figure 3:
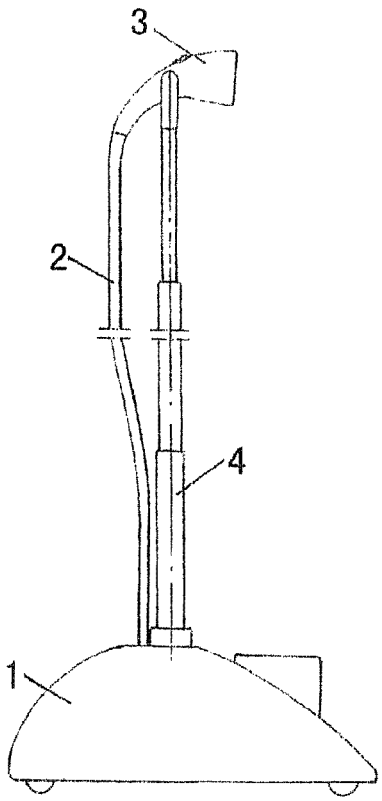
FIG. 3 is a schematic view of the configuration of the clothing steam ironing apparatus according to a second embodiment of present invention.

FIGS. 3, 4 illustrate a second embodiment of present invention. In FIGS. 3, 4 same elements are denoted by same reference sign, for the purpose of clarity, the description about same elements will not be repeated.

FIG. 4 illustrates the control switch 12 of the fan. According to the second embodiment of present invention, the configuration of the steam chamber 5 and the air suction chamber 6 is different from that in the first embodiment. More specifically, though the steam chamber 5 and the air suction chamber 6 are separated from each other too, as illustrated in FIG. 4, the area that the steam chamber 5 contacts the ironing panel is much larger than the area that the air suction chamber 6 contacts the ironing panel. Correspondingly, the locations of the steam ejection holes 7 and suction holes 8 are also different from that in the first embodiment. In the second embodiment, the steam ejection holes 7 and the suction holes 8 are formed at the upper side and the lower side of the ironing panel respectively.

In addition, in order to improve the dust cleaning effect, a dust collection device 13 with a filter is provided between the fan 9 and the suction holes 8. Preferably, the dust collection device 13 is a vertical flat box-like body, with a front end and a rear end opened. The filter for preventing the dust entering into the dust collection device 13 from leaving is mounted in the inside of the rear end opening of the flat box-like body. The dust collection device 13 is inserted and fitted in the air suction chamber 6 though an opening at the underside of a housing of the ironing component 3. The dust collection device 13 could be integrally detached from the ironing component 3, so that the user could dump the dust accumulated in the dust collection device and clean the filter. An air vent 11 is provided in the housing of the ironing component 3 at the rear lower side (or rear upper side) of the fan 9, the air drawn into the air suction chamber 6 by the fan 9 though the air suction holes 8 flow out through the air vent 11. The air flow as discussed above will generate a sucking force acted on the clothing to be ironed or cleaned, meanwhile serve as a cooling air flow for the fan.

Figure 6:
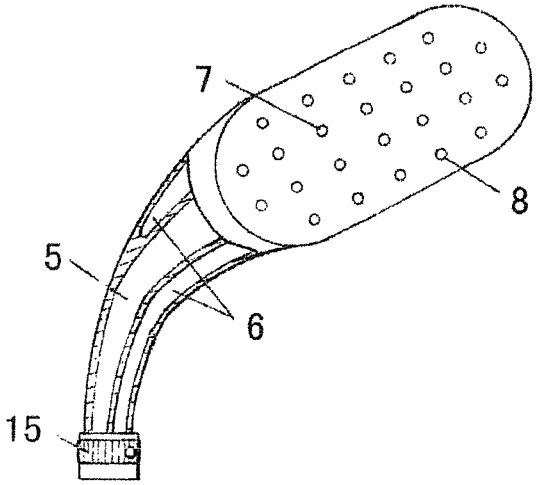
FIG. 6 is a schematic view of an ironing component of the clothing steam ironing apparatus according to a third embodiment of present invention.

In FIGS. 5, 6, the third embodiment of present invention is illustrated, and the elements same with that of the first and second embodiment are denoted by the same reference signs. For the same configurations, the descriptions will be omitted.

Referring to FIG. 5, in accordance with the third embodiment of present invention, the location of the fan 9 is different from that in the first and second embodiments. More specifically, the fan 9 is provided in the mount 1. The air discharging port of the fan 9 is in fluid communication with the air outlet 10 formed in a housing of the mount 1, and the air intake port of the fan 9 connects with a flexible intake pipe 14. The other end of the intake pipe 14 is in fluid communication with the air suction chamber 6 of the ironing component 3.

Besides, according to the third embodiment of present invention, a suction adjusting valve 15 is provided in the ironing component 3. The valve 15 could be configured as a ring body and mounted at the lower end of the ironing component 3. An air inhaling hole is formed in the ring body of the valve 15, and a corresponding air inhaling hole communicating with the air suction chamber 6 could be provided in the ironing component 3. By rotating the ring body, the air flow through the two air inhaling holes could be adjusted, up to the maximum flow rate or be reduced to zero (closed up). Thus the sucking force acted on the clothing to be ironed could be adjusted to meet various ironing requirements for different materials of the clothing.

Preferably, a filter 16 is provided in the housing of the mount 1 and fits with the air outlet 10, so that the air discharged by the fan 9 is filtered by the filter 16. To facilitate the cleaning work, the filter 16 preferably is removably mounted in the housing of the mount.

According to present invention, the fan could be provided in the ironing component or be provided in the mount, correspondingly, the dust collection device could be arranged in the ironing component or be arranged in the mount. As a basic teaching of the principle of present invention, those skilled in the art could readily envisage other modifications suitable for actual need.

Although several exemplary embodiments have been shown and described, it would be appreciated by those skilled in the art that various changes or modifications may be made in these embodiments without departing from the principles and spirit of the disclosure, the scope of which is defined in the appended claims and their equivalents.

The invention claimed is:

1. A clothing steam ironing apparatus with cleaning function, comprising a mount including a steam generating device therein, the mount is equipped with a vertical telescopic pole bracket, a steam pipe connects with the steam generating device at one end and connects with an ironing head at the other end, characterized in that the ironing head comprising a steam ejection chamber and an air suction chamber, steam ejection holes connecting with the steam ejection chamber and air suction holes connecting with the air suction chamber are formed in an ironing panel of the ironing head to iron a clothing, a fan is mounted in the air suction chamber, a dust collection device with a filter is provided between the fan and the air suction holes, and an air outlet vent for the air suction chamber is provided in a housing of the ironing head at a rear lower side or rear upper side of the fan, wherein an area that the steam ejection chamber contacts the ironing panel is larger than an area that the air suction chamber contacts the ironing panel, and the steam ejection holes and the suction holes are formed at an upper side and a lower side of the ironing panel respectively; and wherein the steam ejection holes connect with the steam ejection chamber in the ironing panel at least at a location adjacent to an edge of the upper side of the ironing panel, where the steam ejection holes are not surrounded by the air suction holes.

2. A clothing steam ironing apparatus, comprising an ironing component with an ironing panel, characterized in that the ironing component comprises:

steam ejection holes for ejecting steam to iron a clothing and air suction holes for generating a suck force to the clothing are provided in the ironing panel, a steam chamber and an air chamber separated from the steam chamber, the steam chamber being in fluid communication with the steam ejection holes and the air chamber being in fluid communication with the air suction holes, and an air vent being in fluid communication with the air chamber, a fan being provided in the air chamber, wherein an area that the steam chamber contacts the ironing panel is larger than an area that the air suction chamber contacts the ironing panel, and the steam ejection holes and the suction holes are formed at an upper side and a lower side of the ironing panel respectively, wherein the steam ejection holes connect with the steam chamber in the ironing panel at least at a location adjacent to an edge of the upper side of the ironing panel, where the steam ejection holes are not surrounded by the air suction holes; and wherein a dust collection device, equipped with a filter, is provided between the fan and the air suction holes.

3. The clothing steam ironing apparatus according to claim 2, further comprising a mount for providing steam.

4. The clothing steam ironing apparatus according to claim 2, further comprising a fan control switch for switching the fan on and off and for adjusting the velocity of the wind blown by the fan.

* * * * *